US009446297B2

(12) United States Patent
Darmon

(10) Patent No.: US 9,446,297 B2
(45) Date of Patent: Sep. 20, 2016

(54) DEVICE FOR THROWING BALLS

(75) Inventor: Stéphane Darmon, Perpignan (FR)

(73) Assignee: HOLDING DARMON-JOFRE, Perpignan (FR)

( * ) Notice: Subject to any disclaimer, the term of this patent is extended or adjusted under 35 U.S.C. 154(b) by 81 days.

(21) Appl. No.: 13/820,509

(22) PCT Filed: Sep. 2, 2011

(86) PCT No.: PCT/FR2011/052019

§ 371 (c)(1), (2), (4) Date: Mar. 18, 2013

(87) PCT Pub. No.: WO2012/028831

PCT Pub. Date: Mar. 8, 2012

(65) Prior Publication Data

US 2013/0210555 A1 Aug. 15, 2013

(30) Foreign Application Priority Data

Sep. 3, 2010 (FR) ..... 10 56987

(51) Int. Cl.
*A63B 69/40* (2006.01)
*F41B 3/03* (2006.01)

(52) U.S. Cl.
CPC ..... *A63B 69/408* (2013.01); *A63B 69/40* (2013.01); *F41B 3/03* (2013.01)

(58) Field of Classification Search
CPC ..... A63B 69/408; A63B 69/407; A63B 69/0075; A63B 69/40; F41B 3/03
USPC ..... 124/7, 16, 36, 41.1, 50, 54, 8; 473/107, 473/438, 446, 422
See application file for complete search history.

(56) References Cited

U.S. PATENT DOCUMENTS 1,552,191 A * 9/1925 Bahlmann ..... F41J 9/30 124/26
1,638,283 A * 8/1927 Bahlmann ..... F41J 9/30 124/26
3,128,752 A * 4/1964 Andersen ..... 124/16
3,470,859 A * 10/1969 Ponza ..... 124/7
3,610,223 A * 10/1971 Green ..... A63B 69/408 124/16
3,926,170 A * 12/1975 Dixon ..... A63B 69/408 124/41.1
3,951,125 A * 4/1976 Dixon ..... A63B 69/408 124/36
4,015,578 A * 4/1977 Wright ..... 124/7
4,122,822 A * 10/1978 Scheiwiller ..... A63B 69/408 124/36
4,254,755 A * 3/1981 Morgan ..... A63B 69/408 124/16
4,345,577 A * 8/1982 Andersson ..... A63B 69/408 124/16
4,365,612 A * 12/1982 Defosse ..... A63B 69/40 124/41.1

(Continued)

FOREIGN PATENT DOCUMENTS

CH 0 395 830 A 7/1965
FR 2 472 397 A1 7/1981
FR 2 495 476 A1 6/1982

*Primary Examiner* — Alexander Niconovich
(74) *Attorney, Agent, or Firm* — Andrew W. Chu; Craft Chu PLLC

(57) ABSTRACT

The device for throwing balls includes a frame having a striking mechanism formed of a striking arm and a striker. The striker is provided at the free end of the striking arm, and the striking arm is pivotably mobile via a shaft and combined with a driver suitable for pivoting the arm such that the striker can follow a circular path passing through a location intended to receive a ball. The striker includes a roller mounted so as to be freely rotatable about an axis parallel to that of pivoting of the striking arm.

16 Claims, 2 Drawing Sheets

(56) References Cited

U.S. PATENT DOCUMENTS 4,523,573 A * 6/1985 Defosse ..... A63B 69/40 124/41.1
4,593,673 A * 6/1986 Kees ..... 124/20.3
4,995,371 A * 2/1991 Kuizinas ..... A63B 47/002 124/36
5,415,150 A * 5/1995 Dallas ..... A63B 69/407 124/16
5,465,978 A * 11/1995 Magnone ..... A63B 69/0024 124/7
5,619,977 A * 4/1997 Gatin ..... 124/7
5,697,613 A * 12/1997 Merino et al. ..... 273/129 W
5,720,664 A * 2/1998 Brubacher ..... F41J 9/24 124/8
5,759,083 A * 6/1998 Polumbaum ..... A63H 17/006 273/129 V
5,911,214 A * 6/1999 Andrews ..... A63B 69/408 124/16
6,019,095 A * 2/2000 Sommer ..... A63D 3/02 124/4
6,546,923 B2 * 4/2003 Erickson ..... A63B 69/407 124/16
6,715,477 B1 * 4/2004 Gilman ..... A63B 69/40 124/16
6,715,478 B1 * 4/2004 Tanner ..... A63B 69/408 124/16
7,066,846 B2 * 6/2006 Horkan ..... A63B 69/002 124/7
7,549,415 B2 * 6/2009 Karellas ..... 124/16
7,628,147 B2 * 12/2009 Estalella ..... 124/7
7,806,788 B1 * 10/2010 Neuman ..... A63B 69/408 124/4
8,286,619 B2 * 10/2012 Mihaljevic ..... A63B 69/408 124/16
8,342,161 B2 * 1/2013 Harwath et al. ..... 124/44.5
9,067,118 B2 * 6/2015 Colding-Kristensen ..... A63B 69/408
9,086,257 B2 * 7/2015 Laporte ..... F41J 9/16
2010/0258100 A1 * 10/2010 Kusiak et al. ..... 124/10

* cited by examiner

DEVICE FOR THROWING BALLS

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The object of the present invention is a device for throwing balls, namely for collective sports.

The invention is related to the field of the sports training appliances, and in particular to the field of the appliances for projecting balls, as well as to that of the games or toys for projecting balls.

The object of the invention is in particular the improvement of the existing devices for throwing balls, in which the balls are struck by means of a striking arm, such as those described in WO 2008/056038 and EP 0 520 929.

2. Description of Related Art Including Information Disclosed Under 37 CFR 1.97 and 37 CFR 1.98.

These devices generally include a frame incorporating a ball magazine and a striking mechanism, the latter including a striking arm provided at its free end with a striking means movable in pivoting through a shaft and associated with driving means capable of driving in pivoting so that said striking means can describe a path passing through a location aimed at receiving a ball delivered by said magazine. The driving means essentially comprise an energy accumulator capable, under the action of a control means, of restituting and transmitting this energy to said shaft and, thus, to the striking arm.

These devices are in particular for teaching collective sports using a ball, for learning technical movements. They permit to reproduce ball throws following regular paths.

The device of EP 0 520 929 includes a striking arm moving in a vertical or substantially vertical plane, while WO 2008/056038 includes a striking arm moving in a horizontal or substantially horizontal plane. These arms are provided at their free end with a striking means, which is in the form of a plate or the like, and which is aimed at entering into contact with the ball.

In practice, it has been observed that the path of the ball did not follow a line tangent to the circle described by the striking means, but that it departed from same, so that the user had to move laterally in order to receive the throw, this effect is due to the path of the striking means not being rectilinear, to the impact not having a direction perfectly radial to the ball, and to it occurring on a relatively extended surface with a force that is not distributed homogeneously, and with a possible displacement, even a sliding, of the ball with respect to the striking means.

In order to cope with this drawback, i.e. to obtain a path substantially tangent to the circle followed by the striking means, it has been observed that the point of impact of the striking means on the ball should be modified, which has however the drawback, in addition to the fact that the desired path is obtained only by trials at the level of the settings, when such is possible, with less effectiveness, since the point of impact corresponding to the optimal energy transmission is different from the point of impact permitting to optimize the path.

SUMMARY OF THE INVENTION

The aim of the present invention is to provide a device for throwing balls permitting to cope with the various above-mentioned drawbacks.

The device for throwing balls according to the invention includes a frame incorporating a striking mechanism including a striking arm provided at its free end with a striking means, said arm being movable in pivoting through a shaft and associated with driving means capable of driving in pivoting so that said striking means can describe a circular path passing through a location aimed at receiving a ball, and it is essentially characterized in that said striking means consists of a roller mounted so as to freely rotate about an axis parallel to that of pivoting of said striking arm.

During the striking, the roller can turn into contact with the ball, which permits a re-centering of the impact. During the impact, there is no displacement of the ball with respect to the roller, the alignment correction does not occur through sliding of the ball on the striking means, but through pivoting of the roller, which has thus a function of positioning damper.

According to an additional feature of the device for throwing balls according to the invention, the location aimed at receiving the ball is in the form of a tray provided with means for positioning the ball, and associated with adjusting means permitting a vertical and/or lateral displacement.

According to another additional feature of the device for throwing balls according to the invention, the tray has the shape of a gutter, so as to permit to center the ball in same, irrespective of the size of the latter.

According to another additional feature of the device for throwing balls according to the invention, the means for positioning the ball on the tray consist of brushes permitting to maintain the ball by being placed on both sides of the location aimed at being occupied by the latter.

According to another additional feature of the device for throwing balls according to the invention, the driving means comprise a mechanical energy accumulator capable of storing the mechanical energy produced by a geared motor, and capable of restituting and transmitting this energy to the shaft, said energy accumulator being in addition made integral with the frame and connected to said shaft at a fastening point eccentric with respect to the axis of rotation of said shaft, while said driving means comprise means eccentric with respect to said axis of rotation put into rotation about this axis by being driven by said geared motor, and capable of cooperating with said shaft, so as to drive it in pivoting, only by resting eccentrically on a portion of the latter or on an element integral with the latter.

According to another additional feature of the device for throwing balls according to the invention, the energy accumulator consists of a mechanical and/or pneumatic compression or draw spring.

According to another additional feature of the device for throwing balls according to the invention, the energy accumulator (5) is associated with means for adjusting its tension.

According to another additional feature of the device for throwing balls according to the invention, it includes means for attenuating the oscillations of the arm on its shaft after striking a ball.

According to another additional feature of the device for throwing balls according to the invention, the means for attenuating the oscillations of the arm consist of a free wheel through which the shaft is mounted on the frame, or of a single-duty damper coaxial to the mechanical energy accumulator.

The advantages and features of the device for throwing balls according to the invention will become clear from the following description, which relates to the attached drawing, which represents a non-restrictive embodiment of same.

DETAILED DESCRIPTION OF THE DRAWINGS

Figure 1:
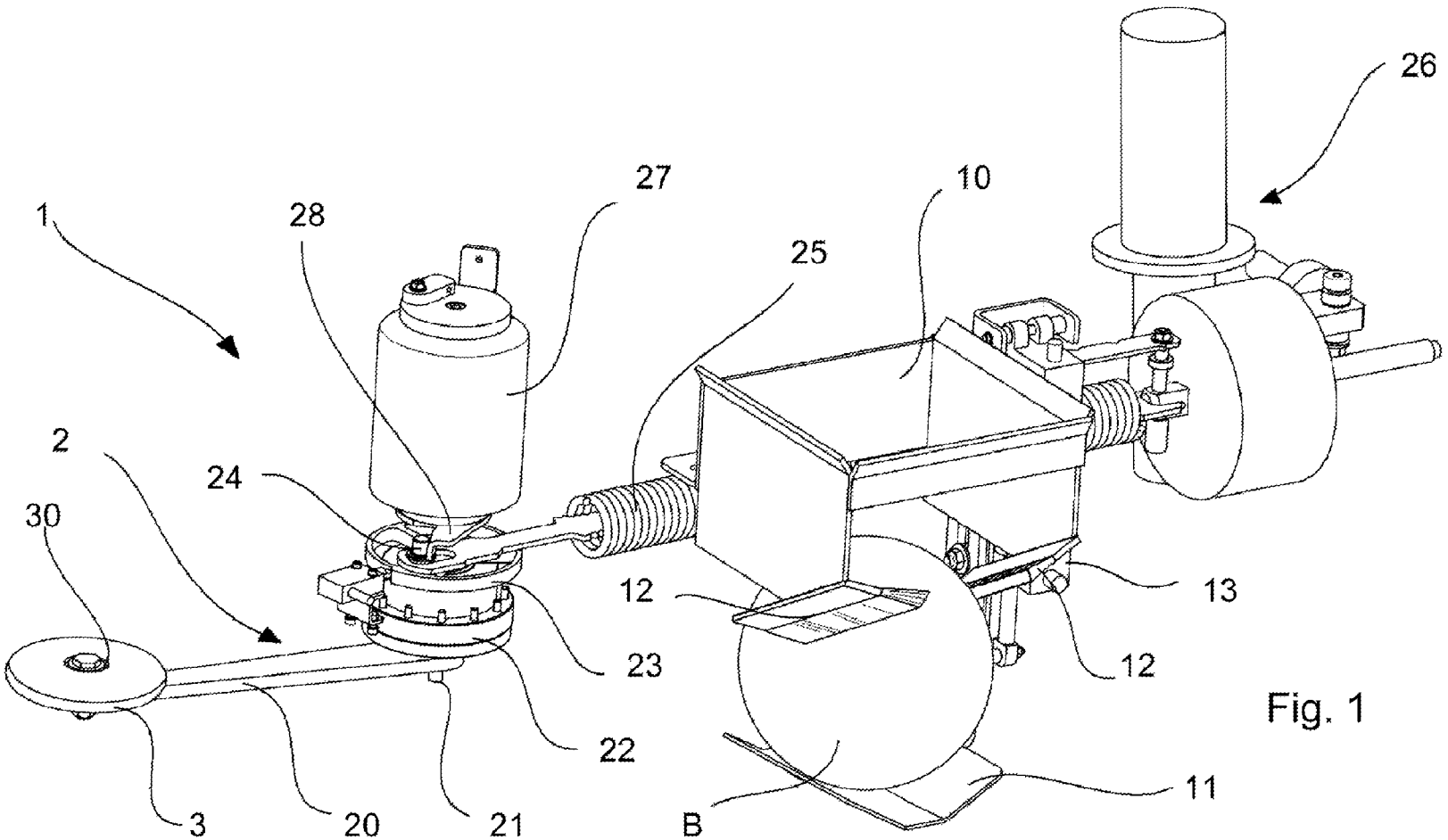
FIG. 1 represents a schematic partial and perspective view of a device for throwing balls according to the invention.

In FIG. 1 has been shown the essential part of the mechanism of a device 1 for throwing balls B according to the invention. It should be noted that most of the features represented and relating to the operation are those described in WO 2008/056038, knowing that other embodiments are feasible.

Thus, this device 1 includes, inside a frame, not shown, a striking mechanism 2 comprising a striking arm 20 mounted on a shaft 21 movable pivotally on the frame through a free wheel 22.

An eccentric 23, fixed in rotation on the shaft 21, is connected, through an eccentric fixing pawl 24, at one end of a mechanical energy accumulator, in this case a spring 25, the other end of which is integral with a means 26 for adjusting the tension of the spring 25. On the other hand, a geared motor 27 is designed capable, on the one hand, of pushing, through a resetting stop 28, the pawl 24 in rotation about the shaft 21, so as to decompress the spring 25, and on the other hand to release this pawl 24 in order to permit, under the action of the decompression of the spring 25, the rotation of the shaft 21 and, thus, the displacement of the striking arm 20.

The device 1 also includes a magazine for storing balls B, only the end of which is shown, which consists of a hopper 10 hanging over the location aimed at receiving the ball B to be thrown. This location is embodied by a tray 11 associated with two brushes 12 arranged laterally, on both sides of the location aimed at being occupied by the ball B, the tray 11 being of course arranged on the path of the free end of the striking arm 20.

Advantageously and preferably, the tray 11 is in the form of a gutter curved about an axis tangent to the path of the free end of the striking arm 20. This gutter-shape permits to index the positioning of the ball B, irrespective of the size of the latter.

Figure 2:
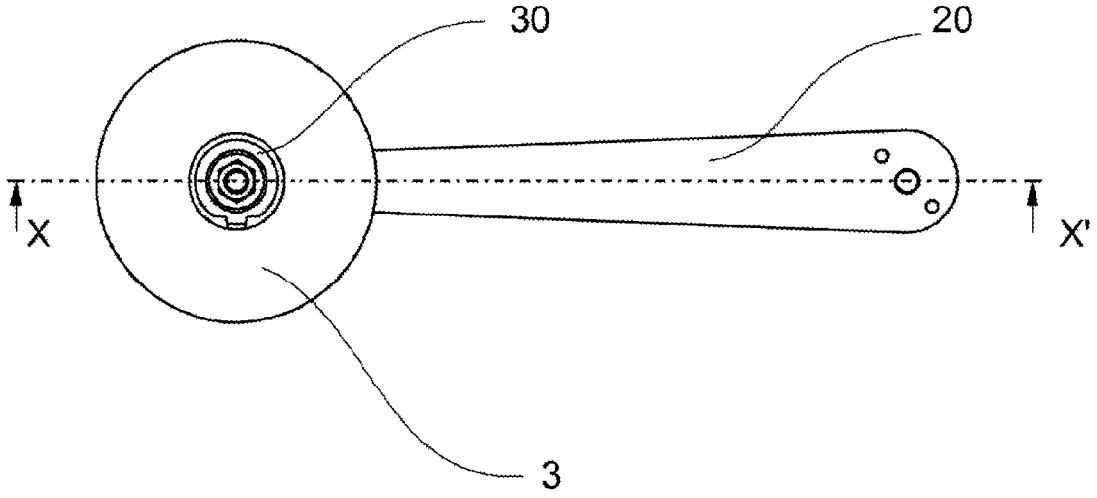
FIG. 2 represents a schematic plan view of a portion of the same device.
Figure 3:
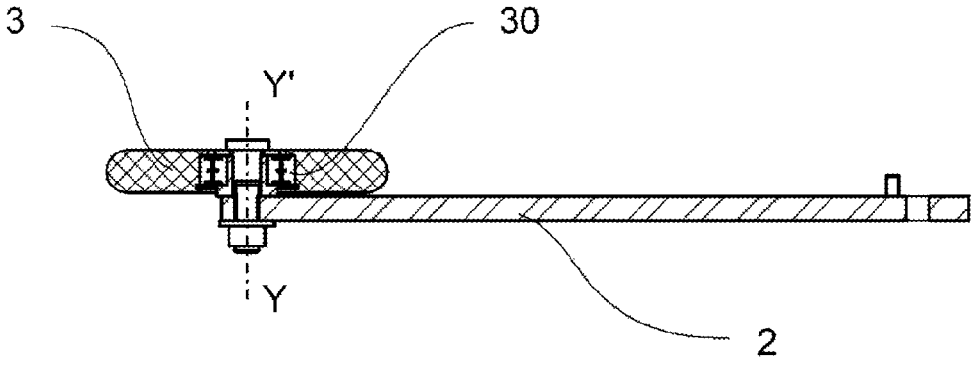
FIG. 3 represents a schematic longitudinal cross-sectional view according to the axis XX' of FIG. 2.

When referring also to FIGS. 2 and 3, one can see that the free end of the striking arm 20 is provided, according to the invention, with a roller 3 mounted so as to freely pivot about axis YY' parallel to the shaft 21, by means of a bearing 30. The roller 3 constitutes the striking element aimed at entering into contact with the ball B.

In operation, the pawl 24 is driven in rotation about the axis of pivoting of the shaft 21 by the geared motor 27, while being pushed by the resetting stop 28, which results into the displacement of the striking arm 20 and the putting under draught of the spring 25. When the pawl 24 is in a position diametrically opposite the point of fastening of the other end of the spring 25, the latter is decompressed at maximum, and when the pawl 24 exceeds this position, the spring 25 contracts and suddenly drives in pivoting the shaft 21 and, thus, the striking arm 20. The roller 3 thus describes a circular path that passes through the location occupied by the ball B on the tray 11.

Upon impact, which occurs without bouncing of the roller 3 because of the presence of the free wheel 22, the resetting stop 28 is brought into contact with the pawl 24, which it drives for a new cycle.

It should be noted that it is also possible to use, in substitution of the free wheel 22, for example a single-duty damper coaxial to the spring 25.

The contact with the ball B thus occurs through the roller 3, and because of the possibility of rotation of the latter, there is no sliding effect during the impact.

Advantageously, the tray 11 in the form of a gutter is mounted movably in vertical translation through an adjusting means such as a screw jack 13. This possibility of adjusting permits, irrespective of the size of the ball B, that the impact can be given at the desired location, i.e. optimally, at a median height.

It should be noted that, optionally, the device 1 can include means for adjusting in lateral direction the tray 11, or more specifically the unit formed by the hopper 10, the tray 11 and the brushes 12, so as to perform a lateral displacement of same, on either side, and to thus obtain throws according to different paths oriented laterally.

The roller 3 of the device 1 for throwing balls according to the invention permits to perform throws with high precision, and thus with a higher effectiveness for the user. The association of this roller 3 with the tray 11 in the form of a gutter and with two brushes 12 arranged laterally permits to increase the precision of the throws.

I claim:

1. A device for throwing balls, comprising:

a frame incorporating a striking mechanism, said striking mechanism being comprised of a striking arm and a striking means, said striking means being provided at a free end of said striking arm, said striking arm being rotatable about a shaft with a first axis of rotation;

a driving means attached to said shaft, said driving means rotating said striking arm in a circular path centered on said first axis of rotation so as to pass said striking means through a location aimed at receiving a ball, said striking arm rotating at least 360 degrees on said circular path; and a tray placed at said location aimed at receiving said ball;

a means for positioning the ball cooperative with said tray; and an adjusting means engaged to said tray, said tray being displaced vertically, laterally or both by said adjusting means so as to align the ball with said striking means at said location, wherein said striking means is comprised of a roller mounted on a bearing with a second axis of rotation, said roller being rotatable about said bearing, said first axis of rotation being parallel to said second axis of rotation.

2. The device for throwing balls according to claim 1, wherein said tray is comprised of a gutter, so as to center the ball in said tray.

3. The device for throwing balls according to claim 1, wherein said means for positioning the ball comprises brushes on both sides of the location aimed at receiving said ball.

4. The device for throwing balls according to claim 1, wherein said driving means comprises:

a geared motor; and a mechanical energy accumulator storing mechanical energy produced by said geared motor, being made integral with said frame, and connecting to said shaft at a fastening point eccentric to said first axis of rotation, wherein said mechanical energy accumulator transmits the mechanical energy from said geared motor to said shaft; and a rotating means eccentric with respect to said first axis of rotation being driven by said geared motor, said rotating means cooperating with said shaft, so as to drive rotation of said shaft, said rotating means engaging at least an element integral with said shaft.

5. The device for throwing balls according to claim 4, wherein said mechanical energy accumulator is comprised of a spring, said spring being selected from at least one of a group consisting of a mechanical compression spring, a pneumatic compression spring, a mechanical draw spring, and a compression draw spring.

6. The device for throwing balls according to claim 5, wherein said mechanical energy accumulator is further comprised of a means for adjusting tension of said spring.

7. The device for throwing balls claim 5, further comprising:

means for attenuating oscillations of said striking arm on said shaft after striking a ball.

8. The device for throwing balls according to claim 7, wherein said means for attenuating oscillations comprises:

a free wheel mounted on said frame, said shaft being mounted through said free wheel.

9. The device for throwing balls according to claim 7, wherein said means for attenuating oscillations comprises:

a single duty damper coaxial to said mechanical energy accumulator.

10. The device for throwing balls according to claim 1, wherein said first axis of rotation is vertical, said striking arm rotating in a horizontal plane.

11. A device for throwing balls, comprising:

a frame incorporating a striking mechanism, said striking mechanism being comprised of a striking arm and a striking means, said striking means being provided at a free end of said striking arm, said striking arm being rotatable about a shaft with a first axis of rotation; and a driving means attached to said shaft, said driving means rotating said striking arm in a circular path centered on said first axis of rotation so as to pass said striking means through a location aimed at receiving a ball, wherein said striking means is comprised of a roller mounted on a bearing with a second axis of rotation, said roller being rotatable about said bearing, said first axis of rotation being parallel to said second axis of rotation, and wherein said driving means comprises:

a geared motor; and a mechanical energy accumulator storing mechanical energy produced by said geared motor, being made integral with said frame, and connecting to said shaft at a fastening point eccentric to said first axis of rotation, wherein said mechanical energy accumulator transmits the mechanical energy from said geared motor to said shaft; and a rotating means eccentric with respect to said first axis of rotation being driven by said geared motor, said rotating means cooperating with said shaft, so as to drive rotation of said shaft, said rotating means engaging at least an element integral with said shaft.

12. The device for throwing balls according to claim 11, wherein said mechanical energy accumulator is comprised of a spring, said spring being selected from at least one of a group consisting of a mechanical compression spring, a pneumatic compression spring, a mechanical draw spring, and a compression draw spring.

13. The device for throwing balls according to claim 12, wherein said mechanical energy accumulator is further comprised of a means for adjusting tension of said spring.

14. The device for throwing balls claim 11, further comprising:

means for attenuating oscillations of said striking arm on said shaft after striking a ball.

15. The device for throwing balls according to claim 14, wherein said means for attenuating oscillations comprises:

a free wheel mounted on said frame, said shaft being mounted through said free wheel.

16. The device for throwing balls according to claim 14, wherein said means for attenuating oscillations comprises:

a single duty damper coaxial to said mechanical energy accumulator.

* * * * *